US007217482B2

(12) United States Patent
Kim et al.

(10) Patent No.: US 7,217,482 B2
(45) Date of Patent: May 15, 2007

(54) ELECTROPHOTOGRAPHIC PHOTORECEPTOR CONTAINING A CHELATE COMPOUND

(75) Inventors: Beom-jun Kim, Seongnam-si (KR); Saburo Yokota, Suwon-si (KR); Kyung-yol Yon, Seongnam-si (KR); Hwan-koo Lee, Suwon-si (KR); Seung-ju Kim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 282 days.

(21) Appl. No.: 10/875,276

(22) Filed: Jun. 25, 2004

(65) Prior Publication Data

US 2005/0112486 A1 May 26, 2005

(30) Foreign Application Priority Data

Nov. 20, 2003 (KR) ..... 03-82521

(51) Int. Cl.
*G03G 15/04* (2006.01)

(52) U.S. Cl. ..... 430/66

(58) Field of Classification Search ..... 430/66
See application file for complete search history.

(56) References Cited

U.S. PATENT DOCUMENTS

| | | | | |
|---|---|---|---|---|
| 4,444,862 A | 4/1984 | Yagi et al. | | |
| 5,183,719 A | 2/1993 | Yagi et al. | | |
| 2003/0190545 A1* | 10/2003 | Daimon et al. | ..... | 430/124 |
| 2004/0183883 A1* | 9/2004 | Suzuki et al. | ..... | 347/118 |

FOREIGN PATENT DOCUMENTS

| | | |
|---|---|---|
| JP | 50-98331 | 8/1975 |
| JP | 59-46651 | 3/1984 |
| JP | 11-24293 | 1/1999 |
| JP | 2000-103620 | 4/2000 |
| JP | 2003-5401 | 1/2003 |
| KR | 2003-0082066 | 10/2003 |

* cited by examiner

*Primary Examiner*—Mark A. Chapman
(74) *Attorney, Agent, or Firm*—Roylance, Abrams, Berdo & Goodman, L.L.P.

(57) ABSTRACT

An electrophotographic photoreceptor includes a conductive substrate, a photoconductive layer formed on the conductive substrate containing a charge generating material and a charge transferring material, and a protective layer formed on the photoconductive layer for protecting the photoconductive layer. The protective layer contains an alcohol-soluble polyamide resin and an alcohol-soluble chelate compound. According to the present invention, the electrophotographic photoreceptor has the protective layer with chelate compound has improved adhesive properties to the photoconductive layer and improved the electrostatic characteristic and productivity.

21 Claims, 3 Drawing Sheets

ELECTROPHOTOGRAPHIC PHOTORECEPTOR CONTAINING A CHELATE COMPOUND

This application claims benefit under 35 U.S.C. § 119 from Korean Patent Application No. 2003-82521, filed on Nov. 20, 2003, the entire content of which is incorporated herein by reference.

BACKGROUND OF THE INVENTION

1. Field of the Invention

The present invention relates to an electrophotographic photoreceptor comprising a protective layer containing a polyamide resin. More particularly, the present invention relates to an electrophotographic photoreceptor with improved electric and magnetic properties which has a protective layer containing a polyamide resin and a chelate compound where the chelate compound undergoes a crosslinking reaction with the polyamide resin.

2. Description of the Related Art

An electrophotographic photoreceptor is employed in electrophotographic image-forming apparatuses, such as facsimile machines, copiers, laser beam printers, CRT printers, LED printers, liquid crystal printers, and laser electrophotographic devices. Basically, in the electrophotographic image-forming apparatus, a photosensitive material is electrified and exposed to an image-forming light source to form an electrostatic latent image. Then, the image is developed with toner by applying a developing voltage, and after the toner image is transferred to a recording medium such as paper, the image is fixed thereon.

The electrophotographic photoreceptor comprises a photoconductive layer containing materials such as a charge generating material (CGM) and a charge transferring material (CTM) on an electrically conductive substrate. Generally, the electrophotographic photoreceptor contains an additional functional layer. For example, an undercoating layer is formed between the conductive substrate and the photoconductive layer. Alternatively, a protective layer is formed on the photoconductive layer.

The function of the protective layer (also referred to as surface protective layer; hereinafter collectively referred as to protective layer) is to prevent penetration of a liquid developing agent into the photoconductive layer and to prevent abrasion during the process of cleaning, etc. to protect the photoconductive layer.

In general, the protective layer contains a binder and, if necessary, an inorganic or organic filling agent dispersed therein. Various polymer resins can be used as the binder, and thermosetting resins having high mechanical strength, such as polyurethane resins, are commonly used.

Meanwhile, because polyamide resins have superior solvent resistance, electrical and magnetic characteristics compared to other thermosetting resins, the use of polyamide resins as a binder in the protective layer is being studied. U.S. Pat. No. 5,368,967 discloses the use of the polyamide resin as the binder in the protective layer.

However, polyamide resins generally have poor compatibility with other resins and are highly hydrophilic. Therefore, if the polyamide resin is contained as the binder in the protective layer, the adhesive property of the protective layer to the photoconductive layer decreases. In addition, the electrical characteristic of the protective layer is affected by humidity.

Japanese Patent Laid-Open Nos. Hei3-141365 and 2000-330313 disclose a method of using a polyamide resin after being crosslinked by a polymerizer or a crosslinking agent, in order to solve the problems of the protective layer containing the polyamide resin as the binder. However, this method has problems in that the storage stability of the coating liquid is poor since the crosslinking reaction between the polyamide resin and the polymerizer or the crosslinking agent occurs in a solution state at room temperature. The coating liquid is also difficult to use with the dipping method which is a coating method that typically provides good productivity.

SUMMARY OF THE INVENTION

The present invention is directed to a compound and electrophotographic photoreceptor that overcomes the above problems and disadvantages. An object of the present invention is to provide an electrophotographic photoreceptor having improved adhesive properties between a protective layer and a photoconductive layer. Another aspect of the invention is to provide a photographic photoreceptor having improved electrostatic characteristics. Still another aspect of the invention is to add a chelate compound to a protective layer that includes a polyamide resin as the binder to improve the rate of production of the photographic photoreceptor.

The electrophotographic photoreceptor according to an embodiment of the present invention comprises an electrically conductive substrate; a photoconductive layer formed on said conductive substrate containing a charge generating material and a charge transferring material; and a protective layer formed on said photoconductive layer for protecting the photoconductive layer, wherein said protective layer contains an alcohol-soluble polyamide resin and an alcohol-soluble chelate compound. In one embodiment, the chelate compound contains either titanium or zirconium as a central chelating metal. The chelate compound is at least one selected from the group consisting of acetylacetonato chelate compounds, acetoacetate chelate compounds, lactate chelate compounds and glycolate chelate compounds.

In a preferred embodiment, the protective layer additionally contains a polyvinyl acetal resin. Preferably, the acetalization rate of said polyvinyl acetal resin is 65% or less per mol.

The photoconductive layer has a laminate structure comprising a charge generating layer containing the charge generating material and a charge transferring layer containing the charge transferring material. Alternatively, the photoconductive layer has a single layer structure in which the charge generating material and the charge transferring material are dispersed in a single layer.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE INVENTION

Figure 1:
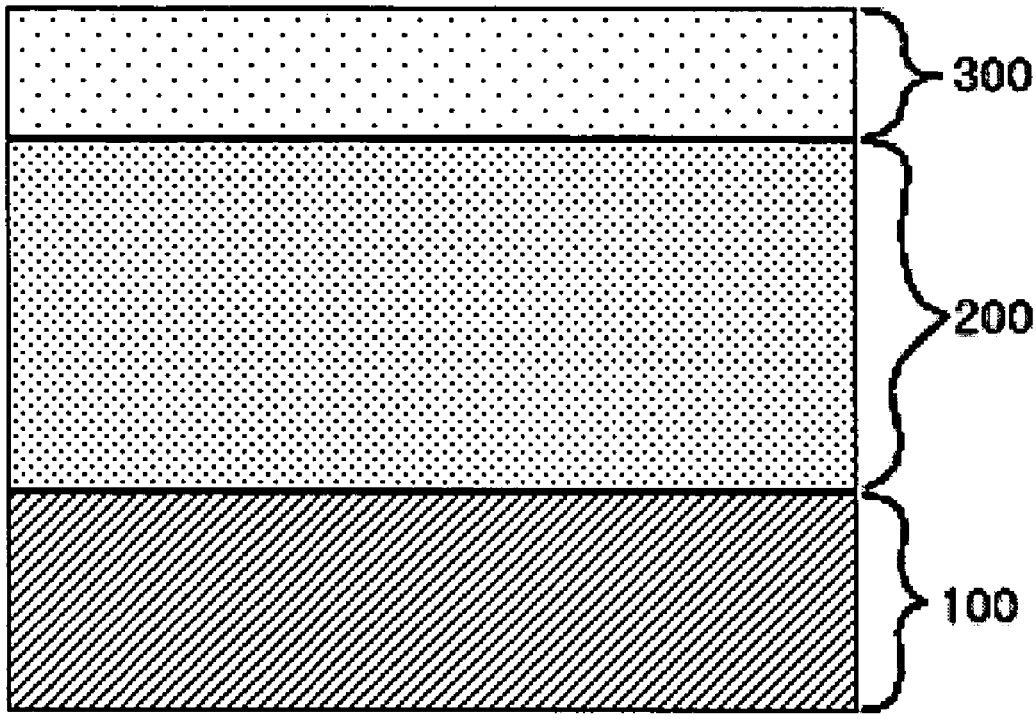
FIG. 1 is a cross-sectional view schematically showing a single layer type electrophotographic photoreceptor according to one embodiment of the present invention.

Certain embodiments of the present invention will be described in greater detail with reference to the accompanying drawings. In the following description, the same drawing reference numerals are used for the same elements in the different figures. The matters defined in the description such as a detailed construction and elements are provided to assist in a comprehensive understanding of the invention, but are not intended to be limiting. Thus, it is apparent that the present invention can be carried out without each of the elements described in the embodiments of the invention. Also, well-known functions and constructions are not described in detail since they are understood by those skilled in the art and to avoid obscuring the invention with unnecessary detail.

FIG. 1 is a cross-sectional view of an electrophotographic photoreceptor according to one embodiment of the present invention comprising a photoconductive layer of a single layer structure. A photoconductive layer 200 is formed on an electrically conductive substrate 100, and a protective layer 300 is laminated on the photoconductive layer 200 in the order shown in FIG. 1.

Figure 2:
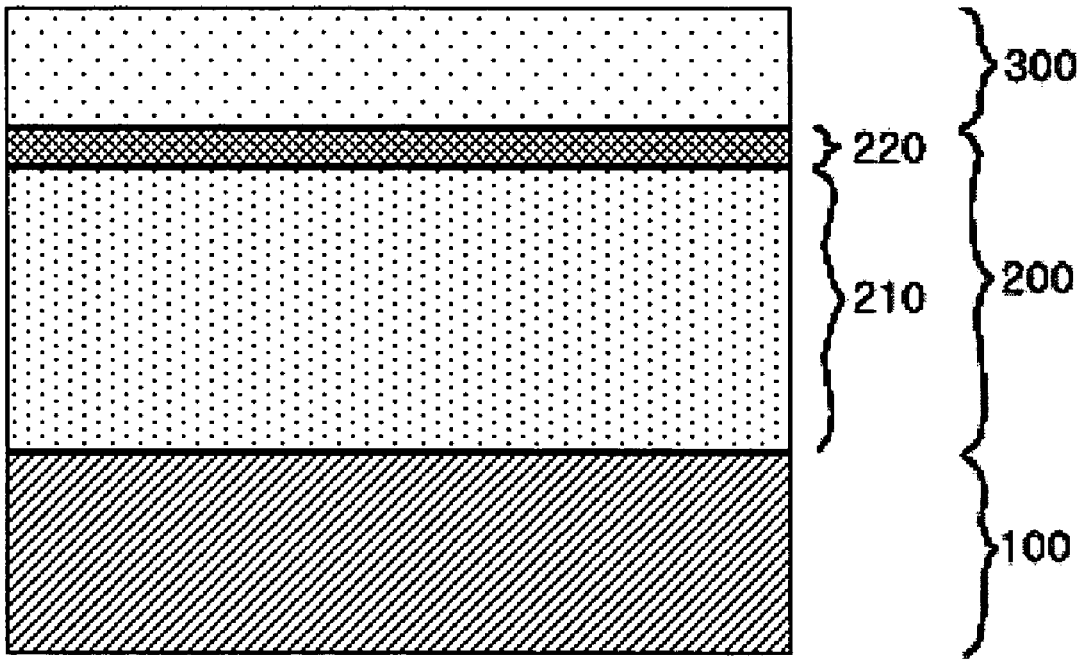
FIG. 2 is a cross-sectional view schematically showing a laminate type electrophotographic photoreceptor according to another embodiment of the present invention.
Figure 3:
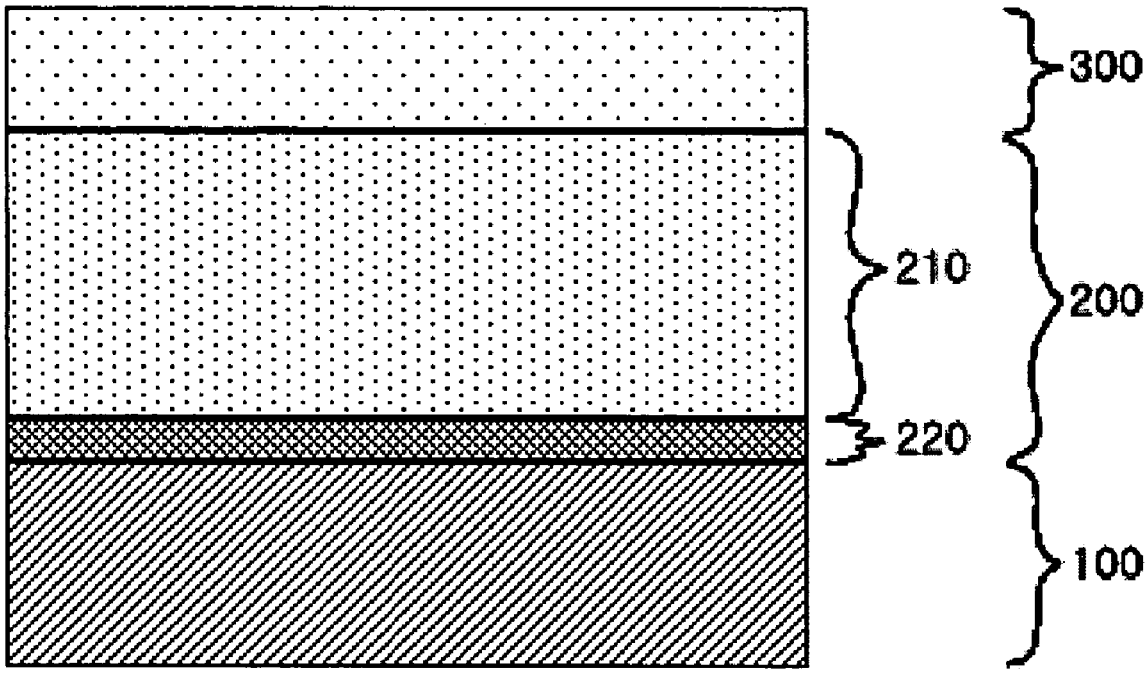
FIG. 3 a cross-sectional view schematically showing a laminate type electrophotographic photoreceptor according to still another embodiment of the present invention.

FIG. 2 and FIG. 3 are cross-sectional views of electrophotographic photoreceptors according to other embodiments of the present invention comprising a photoconductive layer with a laminate structure. A photoconductive layer 200 is formed on an electrically conductive substrate 100, and a protective layer 300 is laminated on the photoconductive layer 200 in the order shown. The photoconductive layer 200 comprises a charge transferring layer 210 and a separate charge generating layer 220. The electrophotographic photoreceptor of FIG. 2 in which the charge generating layer 220 is formed on the charge transferring layer 210, is mainly used for the (+) type electrophotographic photoreceptor. The electrophotographic photoreceptor of FIG. 3 in which the charge transferring layer 210 is formed on the charge generating layer 220, is mainly used for the (−) type electrophotographic photoreceptor.

The conductive substrate of the electrophotographic photoreceptor is electrically conductive. The electrically conductive substrate can be made of various materials including metals, coated plastics and coated glass. Examples of suitable metals include aluminum, copper, tin, platinum, gold, silver, vanadium, molybdenum, chrome, cadmium, titanium, nickel, indium, stainless steel and brass. The plastic materials typically have a metal deposited or laminated thereon. The glasses are typically coated with aluminum iodide, tin oxide, or indium oxide. The materials can be used in the form of a drum or belt as known in the industry.

The photoconductive layer can be either a laminate type structure where a charge generating layer and a charge transferring layer are laminated or a single layer type structure where a charge generating material and a charge transferring material are dispersed in a single layer.

The charge generating material which can be used in the photoconductive layer includes, for example, organic compounds such as phthalocyanine type pigments, azo type pigments, quinone type pigments, pherylene type pigments, indigo type pigments, bisbenzoimidazole type pigments, quinaclydone type pigments, azulenium type pigments, squarium type pigments, pyrilium type pigments, triarylmethane type pigments, and cyanine type pigments. Alternatively, the charge generating material can be inorganic compounds such as amorphous silicon, amorphous selenium, trigonal selenium, tellurium, selenium-tellurium alloy, cadmium sulfide, antimony sulfide, and zinc sulfide. However, the charge generating materials are not limited to these specific examples. The compounds for the charge generating material may be used individually or in combination of two or more.

When the photoconductive layer has a laminate structure, the charge generating layer is formed by dispersing the charge generating material with a binder resin in a solvent and applying the resultant dispersion by coating or forming a film by various processes such as vacuum adsorption, sputtering, and CVD (Chemical Vapor Deposition). The thickness of the charge generating layer is approximately in the range of 0.1 μm to 1 μm.

A photoconductive layer having a single layer structure is formed by dispersing the charge generating material with a binder resin and the charge transferring materials in a solvent and coating the resultant dispersion onto a substrate. The solvent which can be used in the coating liquid for forming the photoconductive layer includes, for example, organic solvents such as alcohol solvents, ketone solvents, amide solvents, ether solvents, ester solvents, sulphone solvents, aromatic solvents, and aliphatic hydrogen chloride solvents. The solvents are not limited to these examples.

The binder resin which can be used in the photoconductive layer can be selected from, for example, polycarbonates, polyesters, methacrylic resins, acrylic resins, polyvinyl chlorides, polyvinylidene chlorides, polystyrenes, polyvinyl acetals, silicone resins, silicone-alkyd resins, styrene-alkyd resins, poly-N-vinylcarbazoles, phenoxy resins, epoxy resins, phenol resins, polyvinyl butyrals, polyvinyl acetals, polyvinyl formals, polysulphones, polyvinyl alcohols, ethyl celluloses, polyamides, carboxymethyl celluloses, and polyurethanes. These high molecular weight polymers may be used individually or in combination with each other.

The charge transferring material of the electrophotographic photoreceptor can be either a hole transferring material or an electron transferring material. The hole transferring material which can be used in the photoconductive layer includes, for example, nitrogen-containing ring compounds or condensed polycyclic compounds of pyrene type, carbazole type, hydrazone type, oxazole type, oxadiazole type, pyrazolin type, arylamine type, arylmethane type, bendizine type, thiazole type, and styryl type. The electron transferring material includes, for example, electron-drawing compounds of benzoquinone type, cyanethylene type, cyano quinodimethane type, fluorenone type, phenantraquinone type, anhydrous phthalic acid type, thiopyrane type, naphthalene type, diphenoquinone type, and stilbenequinone type.

The charge transferring material used in the electrophotographic photoreceptor of the present invention is not limited to the above-mentioned compounds. In addition, the compounds can be used individually or in combination with each other.

The content of the electron transferring material in the photoconductive layer is approximately in the range of 10 to 60% by weight with respect to the total weight of the photoconductive layer. A content of the electron transferring material that is less than 10% by weight is not preferable since the charge transferring capacity is insufficient, the sensitivity is insufficient and the residual potential tends to increase. Also, an electron transferring material content of more than 60% by weight is not preferable since the content of the resin in the photoconductive layer is reduced and the mechanical strength tends to decrease.

The photoconductive layer that has a laminate structure, generally has the charge transferring layer formed on the charge generating layer. Alternatively, the charge generating layer can be formed on the charge transferring layer.

The photoconductive layer having a single layer structure has the charge transferring material dispersed with the charge generating material and the binder resin in the photoconductive layer, so that charge generation occurs inside the photoconductive layer. Therefore, preferably the photoconductive layer transfers both the hole and the electron, so that it is preferable that the hole transferring material and the electron transferring material are used together as the charge transferring material.

The thickness of the photoconductive layer is approximately in the range of 5 μm to 50 μm regardless of whether the photoconductive layer is a laminate type or single layer type.

Furthermore, the photoconductive layer can additionally contain one or more additives which are used with the binder resin. As the additive, crosslinking agents, leveling agents, dispersion stabilizers, antioxidants, and light stabilizers may be used.

The antioxidant includes, for example, antioxidants of phenol type, sulfur type, phosphorous type, and amide type. The light stabilizer includes, for example, benzotriazole compounds, benzophenone compounds, and hindered amine compounds.

In another embodiment, an undercoating layer can be formed between the conductive substrate and the photoconductive layer to improve the adhesive property between the conductive layer and the photoconductive layer and to prevent the entrance of charge from the conductive substrate. The undercoating layer can be made from an anodic oxidation layer of aluminum, a resin dispersion layer of fine powder of metal oxide such as titanium oxide and tin oxide, or a resin layer of polyvinyl alcohol, casein, ethyl cellulose, gelatin, phenol resin, and polyamide. It will be understood that the undercoating layer is not limited to these examples.

The protective layer using an alcohol-soluble polyamide resin as a binder is formed on the photoconductive layer. There are many kinds of alcohol-soluble polyamide resins that can be used such as nylon 6, 8, 11, 12, 66, 610, 612 according to the kind of monomer used in the polymerization process. Copolymers of the polyamide resins and their variants are commercially available and can be used in the protective layer. The polyamide resin includes, for example, products such as AMILAN (Toray), DIAMID and VESTAMID (Daicel-Degussa), ULTRAMID (BASF), and TORESIN (Nagase Chemtex). However, the polyamide resins are not limited to these examples.

The solvent of the protective layer is preferably an alcohol solvent, because non-alcohol type solvents can dissolve the components of the photoconductive layer. An alcohol-soluble polyamide resin dissolved and dispersed in alcohol can be used as the binder resin of the protective layer when an alcohol solvent is used for the protective layer. Examples of suitable alcohols that can be used as a solvent for the polyamide resin and chelate compound include lower alcohols such as methanol, ethanol, propanol, butanol, and mixtures thereof. In one embodiment, the solvent is a mixture of methanol and butanol in a ratio of 3:2 by volume.

The protective layer of the electrophotographic photoreceptor according to the one embodiment is formed by a coating liquid containing an alcohol-soluble chelate compound. An alcohol-soluble chelate compound is used in order to be dissolved and dispersed in the alcohol solvent of the protective layer in the same manner as the polyamide resin.

The alcohol-soluble chelate compound generally has an excellent affinity for the polyamide resin and is effective in improving the adhesive property of the polyamide resin to the substrate or the photoconductive layer. In addition, the chelate compound reacts with a hydroxyl group, amino group, amide group and/or carboxyl group under certain condition to form crosslinks. Therefore, the strength and the moisture resistance of the polyamide resin is remarkably improved by the use of the chelate compound.

The chelate compound has poor crosslinking reactivity under ordinary conditions and functions in a different way than usual crosslinking agents. Thus, the coating liquid has excellent stability, and can be readily used in dip coating methods that are suitable for mass production of electrophotographic photoreceptors. Furthermore, since the polyamide resin bonded with the chelate compound shows the proper and desired conductivity, the deterioration of the electrostatic characteristic due to charge accumulation can be prevented by controlling the mixing ratio of the polyamide resin and chelating agent instead of other conductive or charge transferring filling agents.

Although various alcohol-soluble chelate compounds can be used in the present invention, the preferred chelate compounds are acetylacetonato chelate compounds, acetoacetate chelate compounds, lactate chelate compounds and glycolate chelate compounds, which are represented by the following formulae. Each of chelate compounds is formed through the coordinate bond with a metal ion when acetylacetone, acetoacetic acid, lactic acid or glycolic acid is used as a chelating agent.

The acetylacetonato chelates are represented by the Formula 1.

[Formula 1]

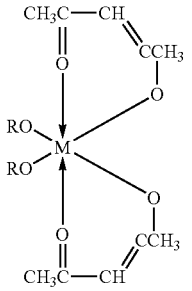

The chelate in which the anion acetylacetonato, referred to as acac⁻ results from acid dissociation of acetylacetone (2,4-pentanedione) coordinated to a metal ion (M). Several kinds of acetylacetonato chelates can be produced depending on the coordination pattern. The chelate of the above Formula 1 is in the form of an enol type chelate coordination complex. Chelates of almost all metals are known.

Acetylacetone exists with keto-enol tautomerism as represented in the Reaction Formula 1.

$$CH_3COCH_2COCH_3 \Leftrightarrow CH_3COCH{=}C(OH)CH_3$$ [Reaction formula 1]

The enol form becomes a monovalent anion as a result of acid dissociation, and coordinates as a biaxial ligand to the metal ion to form the chelate. The 6-atom ring resulting from the formation of the chelate shows benzene-like pseudo-aromaticity because the π-electrons are not localized. Depending on the ion valence of the metal element, chelates with 1 to 4 pendant acac⁻ groups are formed. Most of the chelates are stable solids which have sublimation properties, are more soluble in organic solvents than water, and are used in the solvent extraction of various ions, and thus, are suitable for use as catalysts.

The acetoacetate chelates are represented by Formula 2.

[Formula 2]

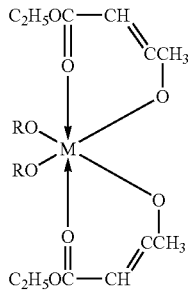

The chelates are formed by reacting acetoacetic acid of the enol form ($CH_3C(OH)=CHCOOC_2H_5$) with a metal (M). The resulting chelate is sparingly soluble in organic solvents.

The lactate chelates in the form of an ammonium salt is represented by Formula 3.

[Formula 3]

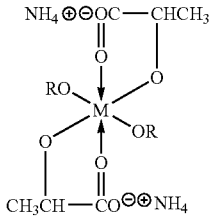

The glycolate chelates are represented by Formula 4.

[Formula 4]

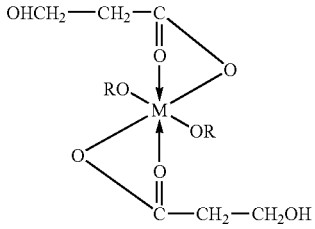

In each of the Formulae 1–4, the substituent R is typically an alkyl group. Examples of suitable R groups include methyl, ethyl, propyl, isopropyl and butyl.

The central metal of the chelate compound used in the present embodiment is preferably selected from titanium and zirconium. The titanium type chelate compound includes, for example, Tyzor® AA, DC and LA (Dupont), and Orgatics TC (Matsumoto Chemical Industry Co., LTD.). Products such as Orgatics ZC (Matsumoto Chemical Industry Co., LTD.) are commercially available forms of the zirconium type chelate compounds. However, the suitable chelates are not limited to these commercial products. In addition, the chelates can be used in combination of each other. The amount of the chelate compound to be added is approximately in the range of 0.01 to 1 part by weight with respect to 1 part by weight of polyamide resin. In this range, the protective layer has good adhesive properties to the photoconductive layer and the polyamide resin shows good conductivity.

The protective layer of the present embodiment also may contain a polyvinyl acetal resin to improve the adhesive property to the photoconductive layer and the dispersion stability of the filling agent. The polyvinyl acetal resin is generally obtained by acetalizing polyvinyl alcohol. There are many kinds of polyvinyl acetal resins depending on the rate of acetalization or the degree of polymerization. Although the kind of polyvinyl acetal resin is not particularly limited, the rate of acetalization is preferably 65% or less by mol, considering the compatibility with the polyamide resin. When the rate is more than 65% by mol, phase separation between the polyvinyl acetal resin and the polyamide resin ocurs, which makes the resin difficult to use.

The polyvinyl acetal resin includes polyvinyl butyral and polyvinyl formal. For example, products such as S-LEC, BM-1, BM-5, BH-3, BL-1, BL-2, BX-L (Sekisui Chemical) can be used, although the invention is not limited to these resins.

The mixing amount of the polyvinyl acetal resin is approximately in the range of 1 to 10% by weight with respect to total weight of the binder resin in the protective layer.

The protective layer according to the present embodiment may contain a charge transferring material or an inorganic or organic filling agent in order to improve electrical, optical, magnetic characteristics. When a charge transferring material is added, either a hole transferring material or an electron transferring material can be selected in order to be suitable for the function of the layer. In this regard, it is preferable to use an alcohol-soluble compound, considering the solubility in solvent and the compatibility with the binder resin.

A suitable filling agent includes fine powders of titanium oxide, silica, aluminum oxide, and tin oxide or organic pigments, or lubricating materials such as PTFE fine powder and wax.

It is preferable that the coating thickness of the protective layer is in the range of approximately 0.1 to 10 μm. If thinner than 0.1 μm, the function of the protective layer can not be achieved. If thicker than 10 μm, exposure to light of the photoconductive layer can be disturbed.

The present invention now will be explained more specifically with reference to the Examples, but the present invention is not limited by these Examples. In the following Examples, "part" means part by weight.

EXAMPLES

Example 1

3 parts of α type titanylphthalocyanine and 2 parts of polycarbonate Z resin (IUPILON Z-200 manufactured by Mitsubishi Gas Chemical Co., Ltd.) were mixed with 45 parts of chloroform, and ground by sand milling for 1 hour to prepare a dispersion.

Then, 15 parts of the electron transferring material represented by the following Formula 5, 30 parts of the hole transferring material represented by the following Formula 6, and 55 parts of the above polycarbonate Z resin were dissolved in 300 parts of chloroform to prepare a solution.

[Formula 5]

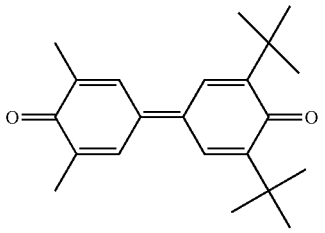

[Formula 6]

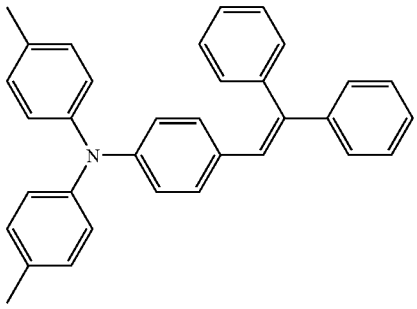

The above dispersion and the above solution were mixed in a mixing ratio of 1:8, and stirred by a homogenizer until the resulting mixture became uniform, to obtain a coating liquid for forming a photoconductive layer. Then, the coating liquid was applied by a ring coating process on a 30 mm diameter aluminum drum which had been treated by anodic oxidation. The resulting coating was dried for 1 hour at 100° C., to obtain a single layer type electrophotographic photoreceptor of 20 μm thickness.

Then, to 50 parts of 8% by weight solution (solvent; methanol:1-butanol=3:2) of alcohol-soluble polyamide resin (AMILAN CM-8000 manufactured by Toray), 0.2 part of polyvinyl acetal resin (S-LEC BM-1 manufactured by Sekisui Chemical Co., Ltd.) and 2 parts of perylene pigment (PALIOGEN MAROON L3920 manufactured by BASF) were added, and dispersed by sand milling for 1 hour to obtain a dispersion. To the dispersion, 0.3 part of acetylacetonato zirconium chelate (Orgatics ZC-150 manufactured by Matsumoto Chemical Industry Co., LTD.) was added and mixed uniformly by a homogenizer to prepare a coating liquid for forming a protective layer. The liquid was coated by a ring coating process on the above single layer type photoconductive layer, and dried for 10 minutes at 130° C., to form a protective layer of 4 μm thickness.

Example 2

On the same aluminum drum as used in Example 1, a solution in which 60 parts of polycarbonate resin (Panlite C-1400 manufactured by Teijin Kasei Co., Ltd.) and 40 parts of the hole transferring material represented by the above Formula 6 were dissolved in 300 parts of chloroform, was coated and dried for 1 hour at 100° C., to form a charge transferring layer of 20 μm thickness.

A coating liquid obtained by dispersing 7 parts of α type titanylphthalocyanine, 6 parts of silicone resin (KR-255 manufactured by Shin-Etsu Chemical Co., LTD.) and 187 parts of methyl ethyl ketone by sand milling. The coating liquid was coated onto the charge transferring layer on the drum by a ring coating process and dried to form a charge generating layer of 0.4 μm thickness. In this way, a laminate type electrophotographic photoreceptor was prepared.

Then, to 50 parts of 8% by weight solution (solvent; methanol: 1-butanol=3:2) of polyamide resin (AMILAN CM-8000 manufactured by Toray), 2 parts of acetylacetonato titanium chelate (Tyzor® AA-75 manufactured by DuPont) was added and mixed uniformly by a homogenizer, to prepare a coating liquid for forming a protective layer. The liquid was coated on the above photoconductive layer by ring coating process, and dried for 10 minutes at 140° C., to form a protective layer having a thickness of 3 μm.

Comparative Example 1

An electrophotographic photoreceptor was prepared in the same manner as in Example 1 except that the chelate compound was not added to the protective layer.

Comparative Example 2

An electrophotographic photoreceptor was prepared in the same manner as in Example 1 except that 0.4 parts by weight of tetraisopropyl titanate (Tyzor® TPT manufactured by DuPont) was used instead of the chelate compound in the protective layer.

Comparative Example 3

An electrophotographic photoreceptor was prepared in the same manner as in Example 2 except that the chelate compound was not included in the protective layer.

{Evaluation}

Storage Stability

After the coating liquids for the protective layer prepared in the Examples and the Comparative Examples were sealed in individual vials and left at room temperature for 1 week, the state of each coating liquid was observed. Coating liquids of Examples 1 and 2 and Comparative Examples 1 and 3 were still stable after storage of 1 week. However, the coating liquid of Comparative Example 2 was gelled where tetraisopropyl titanate was used as a crosslinking agent instead of the chelate compound.

Therefore, in the case of the coating liquid for forming a protective layer, in which a standard crosslinking agent was used, the storage stability of the coating liquid was not guaranteed because the crosslinking agent crosslinked with the binder resin or the like continuously at room temperature. However, in the case of the coating liquids of Examples 1 and 2 in which the chelate compound of the invention was used, the storage stability was guaranteed because the crosslinking reaction does not proceed even after storing at room temperature for a prolonged period of time. The stability was similar to Comparative Examples 1 and 3 in which neither a chelate compound nor a crosslinking agent was used.

Adhesive Property

The adhesive property of each photoconductive layer was evaluated according to the Cross-cut test based on the method JIS-K5400. The test procedure was as follows: Using a cutting knife, a mesh was formed of intersecting cuts into the protective layer of the photoreceptor, to form 100 squares of 1 mm×1 mm each. Place an adhesive tape uniformly over the area of the cuts and remove the tape so that squares are peeled off from the photoreceptor. The number of squares that still remain on the photoconductive layer are counted. The results are represented in Table 1.

TABLE 1

| photo-receptor | Example 1 | Example 2 | Comparative Example 1 | Comparative Example 2 | Comparative Example 3 |
|---|---|---|---|---|---|
| Result | 100/100 | 100/100 | 15/100 | 100/100 | 0/100 |

As shown in the above Table 1, no squares of the protective layer were pulled from the photoreceptors of Examples 1 and 2 according to the present invention. The result was the same as in Comparative Example 2 in which the crosslinking agent was used. These results show the excellent adhesive property between the protective layer and the photoconductive layer.

However, in the case of the photoreceptors of Comparative Examples 1 and 3 which contained neither the chelate compound nor the crosslinking agent, the squares of the protective layer were easily peeled off from the photoconductive layer, and only a few of the squares remained on the photoconductive layer. This shows the poor adhesive property between the protective layer and the photoconductive layer for Comparative Examples 1 and 3.

Electrostatic Characteristic

The electrophotographic characteristic of each photoreceptor was measured using a photoconductive drum evaluation instrument (PDT-200 manufactured by QEA) at an environment of 23° C. and 50% humidity (hereinafter referred to as N/N) and at an environment of 35° C. and 90% humidity (hereinafter referred to as H/H).

The measurement condition was determined by electrifying the drum with 7.5 kV of corona voltage at a condition in which a relative velocity of the electrifier and the photoreceptor was 100 mm/sec. Then after a monochromatic light of wavelength 780 nm was irradiated with an exposure energy changing in the range of 0 to 10 mJ/m$^2$, the surface potential value after exposure was recorded, and the relationship of the energy and the surface potential was measured. In this regard, $V_0$[V] is a surface potential when the light was not irradiated and $V_i$[V] is a surface potential after exposure at 10 mJ/m$^2$. $E_{1/2}$[mJ/m$^2$] is an energy required to decrease $V_0$ by ½. The results are represented in Table 2.

TABLE 2

| Photoreceptor | Environment | $V_0$[V] | $V_i$[V] | $E_{1/2}$[mJ/m$^2$] |
|---|---|---|---|---|
| Example 1 | N/N | 706 | 64 | 3.62 |
| | H/H | 682 | 56 | 3.48 |
| Example 2 | N/N | 857 | 46 | 3.24 |
| | H/H | 824 | 42 | 3.18 |
| Comparative | N/N | 691 | 63 | 3.74 |
| Example 1 | H/H | 563 | 59 | 3.86 |
| Comparative | N/N | 711 | 66 | 3.65 |
| Example 2 | H/H | 694 | 55 | 3.41 |
| Comparative | N/N | 848 | 78 | 3.34 |
| Example 3 | H/H | 653 | 65 | 3.92 |

As shown in the above Table 2, in the case of the photoreceptors of Examples 1 and 2 according to the present invention, differences between the surface potential due to environmental change such as change to high temperature, and high humidity were not very large, so that good electrostatic characteristics were maintained. A similar result was obtained with the photoreceptor of Comparative Example 2 in which the usual crosslinking agent was used.

However, in the case of the photoreceptors of Comparative Examples 1 and 3 the protective layer that contained neither the chelate compound nor the crosslinking agent, the surface potential was largely changed due to environmental changes. In particular, the surface potential was largely decreased at high temperature and high humidity. The change of surface potential decreases the efficiency of the developing agent to be developed to photoreceptor, and accordingly transferring efficiency is decreased. In the end, the quality of printed image is degraded.

In the disclosed embodiments and examples according to the present invention, an electrophotographic photoreceptor comprising a protective layer containing a chelate compound with a polyamide resin, has the high storage stability and excellent adhesive property of the protective layer to the photoconductive layer, and also has excellent electrostatic characteristic and prolonged durability, and provides improved image quality.

While a few exemplary embodiments of the invention have been described and illustrated, it should be understood that the present invention is not limited thereto or thereby. Many alternatives, modifications and variations will be apparent to those skilled in the art without departing from the scope and spirit of the present invention as defined in the following claims.

What is claimed is:

1. An electrophotographic photoreceptor comprising an electrically conductive substrate;

a photoconductive layer formed on said electrically conductive substrate, said photoconductive layer containing a charge generating material and a charge transferring material; and a protective layer formed on said photoconductive layer for protecting said photoconductive layer, wherein said protective layer contains a binding resin including an alcohol-soluble polyamide resin and an alcohol-soluble chelate compound in an amount of 0.01 to 1 part by weight based on 1 part by weight of the polyamide resin.

2. The electrophotographic photoreceptor according to claim 1, wherein said chelate compound has a central metal, and where said central metal is titanium or zirconium.

3. The electrophotographic photoreceptor according to claim 1, wherein said chelate compound is selected from the group consisting of acetylacetonato chelate compounds, acetoacetate chelate compounds, lactate chelate compounds and glycolate chelate compounds.

4. The electrophotographic photoreceptor according to claim 1, wherein said protective layer further contains a polyvinyl acetal resin.

5. The electrophotographic photoreceptor according to claim 4, wherein said polyvinyl acetal resin has an acetalization rate of 65% or less by mol.

6. The electrophotographic photoreceptor according to claim 1, wherein said photoconductive layer has a laminate structure comprising a charge generating layer containing said charge generating material and a charge transferring layer containing said charge transferring material.

7. The electrophotographic photoreceptor according to claim 1, wherein said photoconductive layer has a single layer structure in which said charge generating material and said charge transferring material are dispersed in a single layer.

8. The electrophotographic photoreceptor according to claim 1, wherein said binding resin further includes polyvinyl acetal in an amount of about 1% to 10% by weight based on the weight of the binder resin.

9. The electrophotographic photoreceptor according to claim 8, wherein said protective layer further comprises an alcohol-soluble charge transferring material.

10. The electrophotographic photoreceptor according to claim 9, wherein said charge transferring material is a hole transferring material or an electron transferring material.

11. The electrophotographic photoreceptor according to claim 8, wherein said protective layer includes a filler selected from the group consisting of titanium oxide, silica, aluminum oxide, tin oxide, organic pigments and lubricating materials.

12. The electrophotographic photoreceptor according to claim 1, wherein said protective layer is formed by applying an alcohol solution or dispersion of said polyamide resin and chelate compound to form a layer on said photoconductive layer, and drying the layer to form the protective layer.

13. The electrophotographic photoreceptor according to claim 12, wherein said alcohol solution comprises a lower alcohol.

14. The electrophotographic photoreceptor according to claim 13, wherein said lower alcohol is selected from the group consisting of methanol, ethanol, propanol, butanol, and mixtures thereof.

15. The electrophotographic photoreceptor according to claim 1, wherein said alcohol-soluble chelate compound is included in an amount effective to enhance adhesion of said polyamide resin to said photoconductive layer.

16. An electrophotographic photoreceptor comprising an electrically conductive substrate;

a photoconductive layer formed on said electrically conductive substrate, said photoconductive layer containing a charge generating material and a charge transferring material; and a protective layer formed on said photoconductive layer for protecting said photoconductive layer, wherein said protective layer comprises an alcohol-soluble polyvinyl acetal, an alcohol-soluble polyamide resin, and an alcohol-soluble titanium or zirconium chelate compound, said chelate compound being present in an amount of 0.01 to 1 part by weight based on 1 part by weight of the polyamide, and where the protective layer is formed by applying an alcoholic solution or dispersion of said polyamide and polyvinyl acetal to said photoconductive layer to form a layer, and drying said layer to form said protective layer.

17. The electrophotographic photoreceptor according to claim 16, wherein said chelate compound is selected from the group consisting of acetylacetonato chelate compounds, acetoacetate chelate compounds, lactate chelate compounds and glycolate chelate compounds.

18. The electrophotographic photoreceptor according to claim 16, wherein said polyvinyl acetal resin is included in an amount of 1 to 10% by weight based on the combined weight of the polyamide and polyvinyl acetal resin.

19. The electrophotographic photoreceptor according to claim 18, wherein said polyvinyl acetal resin has an acetalization rate of 65% or less by mol.

20. The electrophotographic photoreceptor according to claim 16, wherein said photoconductive layer has a laminate structure comprising a charge generating layer containing said charge generating material and a charge transferring layer containing said charge transferring material.

21. The electrophotographic photoreceptor according to claim 16, wherein said photoconductive layer has a single layer structure in which said charge generating material and said charge transferring material are dispersed in a single layer.

* * * * *